US005454463A

United States Patent [19]

Meyer

[11] Patent Number: 5,454,463

[45] Date of Patent: Oct. 3, 1995

[54] ELECTRIC STARTING SENSOR FOR BATTERY-OPERATED COIN ACCEPTORS

[76] Inventor: Wilfried Meyer, Appensener Str. 100, 21614 Buxtehude, Germany

[21] Appl. No.: 184,889

[22] Filed: Jan. 21, 1994

[30] Foreign Application Priority Data

Jan. 21, 1993 [DE] Germany ..... 43 01 530.1

[51] Int. Cl.[6] ..... G07D 5/08

[52] U.S. Cl. ..... 194/217; 194/317

[58] Field of Search ..... 194/216, 217, 194/317, 318, 319; 324/236

[56] References Cited

U.S. PATENT DOCUMENTS

| | | | |
|---|---|---|---|
| 3,918,563 | 11/1975 | Schwippert et al. . | |
| 4,460,003 | 7/1984 | Barnes et al. . | |
| 4,601,380 | 7/1986 | Dean et al. | 194/318 |
| 4,895,238 | 1/1990 | Speas | 194/319 |
| 4,926,458 | 5/1990 | Reger et al. | 379/27 |
| 4,979,208 | 12/1990 | Pruden et al. | 379/145 |
| 5,007,520 | 4/1991 | Harris et al. | 194/317 |
| 5,020,653 | 6/1991 | Shimizu | 194/317 |
| 5,027,935 | 7/1991 | Berg et al. | 194/318 |
| 5,036,966 | 8/1991 | Kaspar et al. | 194/217 |
| 5,184,707 | 2/1993 | Van Horn et al. | 194/217 X |
| 5,293,980 | 3/1994 | Parker | 194/317 |
| 5,316,124 | 5/1994 | Barnes et al. | 194/217 X |
| 5,360,095 | 11/1994 | Speas | 194/317 X |

FOREIGN PATENT DOCUMENTS

| | | |
|---|---|---|
| 0058095 | 2/1982 | European Pat. Off. . |
| 0308996 | 11/1984 | European Pat. Off. . |
| 8624368 | 6/1988 | Germany . |
| WO92/09057 | 5/1992 | WIPO . |

*Primary Examiner*—F. J. Bartuska
*Assistant Examiner*—Scott L. Lowe
*Attorney, Agent, or Firm*—Senniger, Powers, Leavitt & Roedel

[57] ABSTRACT

An inductive starting sensor for a battery powered coin acceptor includes an oscillator whose output signal changes when a coin passes through the area of the starting sensor. The sensor includes a capacitor which can be discharged via a resistor. The capacitor is periodically charged via a transistor connected to the oscillator in an emitter follower circuit. The transistor becomes currentless upon a diminution of the oscillator voltage due to the damping of the inductance of the oscillator on account of a passing coin. A further transistor generates a starting signal for the coin acceptor when the first transistor becomes currentless.

24 Claims, 1 Drawing Sheet

ELECTRIC STARTING SENSOR FOR BATTERY-OPERATED COIN ACCEPTORS

BACKGROUND OF THE INVENTION

The invention relates to an inductive starting sensor for battery powered coin acceptors.

Battery powered, electronic coin acceptors should be designed in such a manner that they exhibit a low current requirement both during the operating phase as well as during the rest phase. It is therefore known from German Application No. G 86 24 368 that such coin acceptors can be designed so that they are not "wakened" until when requested. In the rest state the structural parts and components of the electronic coin acceptor are inactive. In this manner the current requirement can be minimized during the rest phase.

The waking of such an electronic coin acceptor takes place with the aid of a starting sensor which is likewise known from German Application No. G 86 24 368 and which can operate inductively. It determines when a coin has been inserted into the coin acceptor. This brings about a damping from which a starting signal can be derived. It is essential for such starting sensors that they are able to operate in a broad temperature range from −30° to +80° C. It would be conceivable to use a temperature compensated integrated circuit for this circuit. However, an integrated circuit can not be used for reasons of current consumption. The current requirement should be less than 10 μA.

Other prior art transistor circuits can also be used. However, relatively large tolerances over the required temperature range result from the use of field effect transistors or bipolar transistors in appropriate electronic circuits so that a reliable response of the starting sensor is not always assured. There is also the danger in the case of the known circuits that if the oscillator fails, e.g. in the case of extreme dewing, a continuous waking signal is produced which naturally puts a load on the battery.

SUMMARY OF THE INVENTION

Among the objects of the present invention are to provide an improved starting sensor for a battery powered coin acceptor; to provide an inductive starting sensor for a battery powered coin acceptor which exhibits a low current consumption and effectively generates a starting signal over a broad temperature range; and to provide a starting sensor which is reliable and economical.

Generally, one form of the invention is an inductive starting sensor for a battery powered coin acceptor including an inductive oscillator whose output signal changes when a coin passes through the area of the starting sensor. The coin acceptor also includes a capacitor, a resistor for discharging the capacitor, and a first transistor connected to the inductive oscillator in an emitter follower circuit for periodically charging the capacitor. The first transistor becomes currentless upon a diminution of the output signal due to the damping of the inductance of the inductive oscillator on account of a passing coin. The coin acceptor also includes a second transistor connected to the battery and to the first transistor for generating a starting signal for the coin acceptor as a function of the first transistor becoming currentless.

Generally, another form of the invention is a starting sensor for a battery powered coin acceptor including an oscillator for producing an output signal. The output signal is diminished in response to a passing coin. The coin acceptor also includes a capacitor, a resistor connected across the capacitor for discharging the capacitor, and a first transistor having a first terminal connected to the oscillator and having a second terminal connected to the capacitor for periodically charging the capacitor as a function of the output signal. The first transistor becomes nonconductive in response to the diminished output signal. The coin acceptor also includes a second transistor for generating a starting signal for the coin acceptor as a function of the first transistor becoming nonconductive.

Other objects and features will be in part apparent and in part pointed out hereinafter.

DETAILED DESCRIPTION OF THE PREFERRED EMBODIMENT

Figure 1:
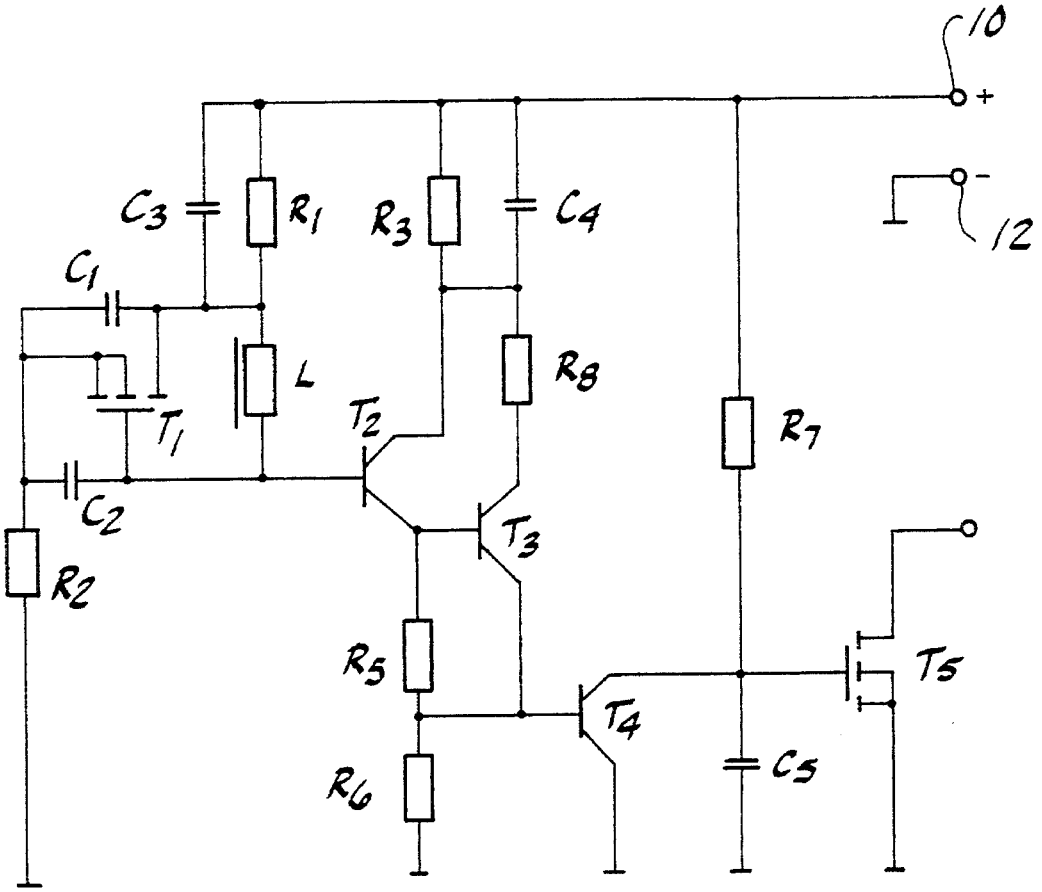
FIG. 1 shows a circuit diagram for a starting sensor.

In the starting sensor of the invention a transistor T2 is connected in an emitter follower circuit to a Colpitts oscillator. The Colpitts oscillator comprises a MOSFET transistor T1, a pair of capacitors C1 and C2 and a sensor coil L. The Colpitts oscillator charges a capacitor C4 to the lower peak value of the output voltage of the oscillator which voltage is on the base emitter junction. A resistor R3 connected in parallel with capacitor C4 discharges the capacitor just enough so that a new recharging of the capacitor takes place upon each lower vertex point of the oscillator output voltage.

If sensor coil L is dampened on account of a coin, the oscillator voltage collapses by a few millivolts and capacitor C4 is no longer charged over a series of periods (e.g. 10 to 50 ms). During this time transistors T2, T3 and T4 are currentless and a waking signal in the form of a LOW signal is generated by a field effect transistor T5.

In order to obtain as stable a temperature behavior as possible and a high circuit quality, a MOSFET transistor is used in the Colpitts oscillator.

As a result of the emitter follower circuit of transistor T2, the amplification is below 1. In order to render the circuit more sensitive, the collector of transistor T2 is connected to the base of a further transistor T3 acting as an amplifier which is connected in series with capacitor C4.

The transistor generating the waking signal is preferably also a field effect transistor T5 whose gate is connected to the collector of transistor T4 and a point between a resistor R7 and a further capacitor C5. The series circuit of resistor R7 and capacitor C5 is connected across a battery B. If transistor T4 becomes currentless, this changes the potential on the gate of transistor T5 and the desired waking signal can be generated.

In more detail, transistor T1 is connected to capacitors C1 and C2 and to sensor coil L to form the capacitively coupled Colpitts oscillator. The oscillator is connected via a parallel circuit of capacitor C3 and of resistor R1 and via resistor R2 to terminals 10 and 12 of battery B belonging to an electronic coin acceptor (not shown). Transistor T2 is also connected to terminals 10 and 12 with series-connected resistors R3, R5 and R6. Transistor T2 is arranged in an emitter follower circuit so that the base of transistor T2 is connected to the output of the Colpitts oscillator. Capacitor C4 is connected in parallel to resistor R3. The collector of transistor T2 is connected to the base of a transistor T3, whose collector is connected via a resistor R8 to a connection point of resistor R3 and capacitor C4. The emitter of transistor T3 is connected between resistors R5 and R6 and is also connected to transistor T4. The collector of transistor T4 is connected to a connection point between resistor R7 and capacitor C5, which are connected in series across terminals 10 and 12 of the battery B. The collector of transistor T4 is also connected to the gate of a field effect transistor TS. A starting or waking signal appears between the drain and the source of transistor T5 when a coin dampens a sensor coil L.

The circuit arrangement shown operates as follows. Capacitor C4 is discharged just enough via resistor R3 that a new recharging of a capacitor C4 takes place at each lower vertex point of the oscillator output voltage. If sensor coil L is damped by a coin, the oscillator voltage collapses by a few mV and capacitor C4 is no longer recharged for many periods, e.g. 10 to 50 ms. During this time transistors T2, T3 and T4 are currentless and the voltage rises on capacitor C5. This causes transistor T5 to become conductive and generates the waking signal.

As can be recognized, the absolute level of the oscillator output voltage is not essential in the circuit shown. Only the change of the level upon the approach of a coin is important. It is possible by means of the method of operation described for the circuit to process the oscillator level from 0.7 to 2 volts without the sensitivity of the circuit changing significantly. Moreover, a further advantage is the fact that upon failure of the oscillator, e.g. in the case of an extreme dewing, no continuous waking signal is generated. Even the clamping of a coin in the area of the starting sensor does not result in a continuous waking signal.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. An inductive starting sensor for a battery powered coin acceptor comprising:

an inductive oscillator whose output signal changes when a coin passes through the area of the starting sensor;

a capacitor;

a resistor for discharging the capacitor;

a first transistor connected to the inductive oscillator in an emitter follower circuit for periodically charging the capacitor; wherein the first transistor becomes currentless upon a diminution of the output signal due to the damping of the inductance of the inductive oscillator on account of a passing coin; and a second transistor connected to the battery and to the first transistor for generating a starting signal for the coin acceptor as a function of the first transistor becoming currentless.

2. The starting sensor according to claim 1 wherein the inductive oscillator comprises a MOSFET transistor.

3. The starting sensor according to claim 1 further comprising a third transistor; wherein the collector of the first transistor is connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

4. The starting sensor according to claim 1 further comprising a second capacitor and a second resistor connected in series to the battery; wherein the second transistor comprises a field effect transistor whose gate is connected at a junction to the second capacitor and the second resistor; wherein the first transistor produces an intermediate signal at its collector terminal; and wherein a signal corresponding to the intermediate signal is output to the junction.

5. The starting sensor according to claim 1 wherein the inductive oscillator comprises a Colpitts oscillator.

6. The starting sensor according to claim 5 further comprising a second capacitor and a second resistor connected in series to the battery; wherein the second transistor comprises a field effect transistor whose gate is connected at a junction to the second capacitor and the second resistor; wherein the first transistor produces an intermediate signal at its collector terminal; and wherein a signal corresponding to the intermediate signal is output to the junction.

7. The starting sensor according to claim 5 wherein the inductive oscillator comprises a MOSFET transistor.

8. The starting sensor according to claim 7 further comprising a third transistor; wherein the collector of the first transistor is connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

9. The starting sensor according to claim 8 further comprising a second capacitor and a second resistor connected in series to the battery; wherein the second transistor comprises a field effect transistor whose gate is connected at a junction to the second capacitor and the second resistor; and wherein a signal corresponding to the intermediate signal generated on the collector of the first transistor is output to the junction.

10. A starting sensor for a battery powered coin acceptor comprising:

an oscillator for producing an output signal, the output signal being diminished in response to a passing coin;

a capacitor;

a resistor connected across the capacitor for discharging the capacitor;

a first transistor having a first terminal connected to the oscillator and having a second terminal connected to the capacitor for periodically charging the capacitor as a function of the output signal; wherein the first transistor becomes nonconductive in response to the diminished output signal; and a second transistor for generating a starting signal for the coin acceptor as a function of the first transistor becoming nonconductive.

11. The starting sensor of claim 10 further comprising a second capacitor and a second resistor connected in series to the battery; wherein the second transistor comprises a field effect transistor whose gate is connected at a junction to the second capacitor and the second resistor; wherein the first transistor further comprises a third terminal for producing an intermediate signal; and wherein a signal corresponding to the intermediate signal is output to the junction.

12. The starting sensor of claim 10 further comprising a third transistor; wherein the first transistor comprises a third terminal connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

13. The starting sensor of claim 12 further comprising a second capacitor and a second resistor connected in series to the battery; wherein the second transistor comprises a field effect transistor whose gate is connected at a junction to the second capacitor and the second resistor; and wherein a signal corresponding to the intermediate signal is output to the junction.

14. The starting sensor of claim 10 wherein the oscillator comprises a MOSFET transistor.

15. The starting sensor of claim 14 further comprising a second capacitor and a second resistor connected in series to the battery; wherein the second transistor comprises a field effect transistor whose gate is connected at a junction to the second capacitor and the second resistor; wherein the first transistor further comprises a third terminal for producing an intermediate signal; and wherein a signal corresponding to the intermediate signal is output to the junction.

16. The starting sensor of claim 14 further comprising a third transistor; wherein the first transistor comprises a third terminal connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

17. The starting sensor of claim 16 further comprising a second capacitor and a second resistor connected in series to the battery; wherein the second transistor comprises a field effect transistor whose gate is connected at a junction to the second capacitor and the second resistor; and wherein a signal corresponding to the intermediate signal is output to the junction.

18. The starting sensor of claim 10 wherein the oscillator comprises a Colpitts oscillator.

19. The starting sensor of claim 18 further comprising a second capacitor and a second resistor connected in series to the battery; wherein the second transistor comprises a field effect transistor whose gate is connected at a junction to the second capacitor and the second resistor; wherein the first transistor further comprises a third terminal for producing an intermediate signal; and wherein a signal corresponding to the intermediate signal is output to the junction.

20. The starting sensor of claim 18 further comprising a third transistor; wherein the first transistor comprises a third terminal connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

21. The starting sensor of claim 20 further comprising a second capacitor and a second resistor connected in series to the battery; wherein the second transistor comprises a field effect transistor whose gate is connected at a junction to the second capacitor and the second resistor; and wherein a signal corresponding to the intermediate signal is output to the junction.

22. The starting sensor of claim 18 wherein the oscillator comprises a MOSFET transistor.

23. The starting sensor of claim 22 further comprising a third transistor; wherein the first transistor comprises a third terminal connected to the base of the third transistor for passing an intermediate signal to the third transistor; wherein the third transistor amplifies the intermediate signal to produce an amplified output signal; wherein the third transistor is connected in series with the capacitor; and wherein the second transistor generates the starting signal as a function of the amplified output signal.

24. The starting sensor of claim 23 further comprising a second capacitor and a second resistor connected in series to the battery; wherein the second transistor comprises a field effect transistor whose gate is connected at a junction to the second capacitor and the second resistor; and wherein a signal corresponding to the intermediate signal is output to the junction.

* * * * *